United States Patent [19]
Rosenbaum et al.
[11] Patent Number: 4,478,276
[45] Date of Patent: Oct. 23, 1984

[54] HEAT-EXCHANGER PARTICULARLY USEFUL FOR LOW TEMPERATURE APPLICATIONS, AND METHOD AND APPARATUS FOR MAKING SAME

[76] Inventors: Ralph L. Rosenbaum, 17 Hashalom St., Ra'anana; Ami S. Breuer, 21 Rambam St., Givatiem, Tel Aviv, both of Israel

[21] Appl. No.: 316,067

[22] Filed: Oct. 28, 1981

[30] Foreign Application Priority Data

Nov. 12, 1980 [IL] Israel ..... 61466

[51] Int. Cl.[3] ..... F28F 13/18; F28F 21/08
[52] U.S. Cl. ..... 165/164; 62/6; 165/DIG. 8; 165/DIG. 10; 165/133
[58] Field of Search ..... 165/DIG. 10, 164, DIG. 8, 165/133; 62/6

[56] References Cited

U.S. PATENT DOCUMENTS

| | | | |
|---|---|---|---|
| 3,794,110 | 2/1974 | Severijns | 165/164 |
| 3,825,064 | 7/1974 | Inoue | 165/DIG. 10 |
| 4,064,914 | 12/1977 | Grant | 165/DIG. 10 |

OTHER PUBLICATIONS

Efficient and Simple Step Heat Exchangers, Rosenbaum et al., Physica 107B (1981) pp. 593–594, North-Holland Publishing Co.
Frossati et al., Physics at Utrálów Temperatures (Phys. Society of Japan, Tokyo (1978) 205.
Frossati, Proc. LTIS, J. de Physique lolloque C-6, vol. 111, (1978) 1578.

*Primary Examiner*—Sheldon J. Richter
*Attorney, Agent, or Firm*—Benjamin J. Barish

[57] ABSTRACT

A step-type heat-exchanger particularly useful for low temperature applications comprises a housing including a thermally-conductive member partitioning its interior into first and second chambers, and a sintered spongy layer of fine thermally-conductive particles bonded to each of the two opposite faces of the thermally-conductive member so as to be exposed for direct contact with a heat-exchange fluid when introduced into each of the two chambers. Also described are a method and apparatus for making the heat-exchanger, in which method and apparatus aluminum pressure plates are applied under heat and pressure to sinter the thermally-conductive particles to form the sintered spongy layers bonded to the opposite faces of the thermally-conductive member.

9 Claims, 5 Drawing Figures

HEAT-EXCHANGER PARTICULARLY USEFUL FOR LOW TEMPERATURE APPLICATIONS, AND METHOD AND APPARATUS FOR MAKING SAME

BACKGROUND OF THE INVENTION

The present invention relates to a heat-exchanger particularly useful for low temperature applications, and also to a method and to apparatus for making such a heat-exchanger. The invention is especially useful in dilution refrigerators based upon the "evaporation" of a helium liquid into a Fermi "gas" for obtaining temperatures approaching absolute zero, and is therefore described below in connection with such an application.

The dilution refrigerator is now a standard research tool used in low temperature laboratories to cool samples continuously below 10 mK (0.010 K) near absolute zero in temperature. The success of the dilution refrigerator depends upon the use of highly efficient heat-exchangers in which the warm incoming $^3$He liquid exchanges heat with the cold exiting gas. At these very low temperatures, a thermal boundary resistance, known as Kapitza boundary resistance, introduces a barrier to heat transfer. This resistance increases as $T^{-2}$ increases to $T^{-3}$ and becomes exceptionally high below 10 mK. To overcome this boundary resistance between the liquids and metal body of the heat-exchanger, large surface contact areas on the order of 10 m$^2$ to 100 m$^2$ are required.

Two types of heat-exchangers, namely the continuous type and the step-type, are now used in cooling samples near absolute zero. The continuous-type heat-exchanger inherently is more efficient and theoretically can produce a lower temperature since it provides a temperature gradient between the inlet and outlet ends of each flow path, e.g., by using low thermal-conductivity materials, such as stainless steel and cupro-nickel alloys. The step-type heat-exchanger does not provide a significant temperature gradient between the inlet and outlet ends of each flow path, and is therefore less efficient, but is frequently much simpler and less expensive to produce.

Until 1978, step-type heat-exchangers has been fabricated from coarse sintered powder copper sponges or fine copper wires; typical contact areas were 0.1 m$^2$. Recently, ultra-fine-diameter silver powder having 700 Å mean diameter, and copper powder having 500 Å mean diameter, have become available (Å$=10^{-8}$ cm). In 1978, this fine silver powder was successfully sintered to a thin cupro nickel foil to form a continuous-type heat-exchanger, commonly called a Frossati heat-exchanger, and it was demonstrated that temperatures of 2 mK could be achieved continuously in the dilution refrigerator using six of these heat-exchangers. This is probably the lowest temperature yet reached by a dilution refrigerator. The contact surface area for each liquid in the Frossati heat-exchanger is about 120 m$^2$, which is about 1000 times greater than the contact area in the earlier step-type heat-exchangers. Several commercial companies have started to manufacture the Frossati the heat-exchanger, but a number of problems have arisen. Thus, the sintering of the very fine powder to both sides of the foil is a complicated procedure requiring that a high pressure, of about 500 Kg/cm$^2$, be applied to the powder and foil at 200° C. in a hydrogen atmosphere. Also, sealing the foil on both sides to confine the liquids within the heat exchanger requires welding a cover to each side of the foil, but the welded joints have been found to be subject to leaks after cycling between room temperature and liquid helium temperatures. Moreover it is very difficult, if possible at all, to thermally anchor electrical wires, experimental feed lines, and a 50 mK thermal shield to the above foil-type heat-exchangers.

BRIEF SUMMARY OF THE INVENTION

An object of the present invention is to provide a novel step-type heat-exchanger particularly useful for low temperature applications having a number of advantages in the above respects, as will be described more particularly below, over the known heat-exchangers. Another object of the invention is to provide a novel method of making the heat-exchanger, and a still further object of the invention is to provide novel apparatus for use in making the heat-exchanger.

According to one broad aspect of the present invention, there is provided a step-type heat exchanger particularly useful for low temperature applications, comprising a housing including a thermally-conductive member partitioning its interior into a first chamber and a second chamber, and a sintered spongey layer of fine thermally-conductive particles bonded to each of the two opposite sides of the thermally-conductive member so as to be exposed along a free face, opposite to its bonded face, for direct contact with a heat-exchange fluid when introduced into each of the two chambers. The housing defines, with the exposed free face of each of the sintered spongy layers, an open flow channel through each of the chambers. The heat exchanger further includes first fluid inlet and outlet means for inletting and outletting a first heat-exchange fluid with respect to said first chamber to flow along the open channel therethrough and in direct contact with the exposed free face of the sintered spongey layer therein; and second fluid inlet and outlet means for inletting and outletting a second heat-exchange fluid with respect to said second chamber to flow along the open channel therethrough and in direct contact with the exposed free face of the sintered spongey layer therein. The sintered spongy layers in the two chambers are of sufficiently high conductivity, and have sufficiently large exposed faces in the open channels of the two chambers, such that there is no significant temperature gradient between the inlet and outlet means of each of the two chambers.

Particularly good results, as will be described below, have been obtained when each of the sintered spongy layers is of sintered silver particles having a particle size of less than 1,000 Å, preferably 700 Å. In the described preferred embodiment, the thermally-conductive member is of copper and is plated with silver to promote the bonding of the sintered spongey layers thereto.

According to a further feature in the described preferred embodiment, the thermally-conductive member is of circular shape, and each of the sintered spongey layer is of substantially annular configuration and includes a barrier between the inlet and outlet of the respective chamber to direct the respective heat-exchange fluid from the inlet to pass over the sintered spongey layer to the outlet of the respective chamber. More particularly, each of the sintered spongey layers is bonded within a substantially annular recess formed in the respective face of the thermally-conductive member, and has a thickness less than the height of the recess to provide a flow-path space for the respective heat-exchange fluid.

According to a further aspect of the invention, there is provided a method of making the above heat-exchanger, characterized in that the thermally-conductive particles are applied to both faces of the thermally-conductive member, and aluminum pressure plates are then applied under heat and pressure to sinter the thermally-conductive particles to form said sintered spongey layers bonded to the opposite faces of the thermally-conductive member.

According to a still further aspect of the invention, there is provided apparatus for use in making the above heat-exchanger in accordance with the above method, comprising a pair of aluminum pressure plates adapted to be disposed on opposite sides of the thermally-conductive member and including projections of the same size and configuration as the sintered spongey layers to be formed thereon, means for securing said aluminum pressure plates together on opposite sides of the thermally-conductive member and in contact with the layers of the thermally-conductive particles on the opposite faces thereof, and means for applying heat to cause said aluminum pressure plates to heat up and to expand, and thereby to sinter the powder to form said sintered spongey layers on the opposite faces of the thermally-conductive member.

It has been found that "step-type" heat-exchangers can be constructed in accordance with the above features having the desirable properties of simplicity, low material cost, excellent reliability, and superior performance characteristics approaching those of an ideal step-type heat-exchanger having infinite surface area.

Further features and advantages of the invention will be apparent from the description below.

BRIEF DESCRIPTION OF THE DRAWINGS

The invention is herein described, by way of example only, with reference to the accompanying drawings, wherein.

DESCRIPTION OF PREFERRED EMBODIMENTS

Figure 1:
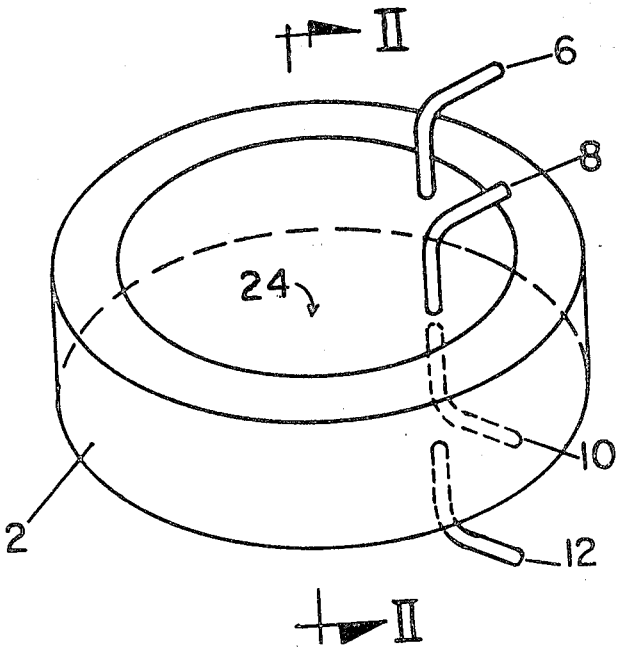
FIG. 1 is a three-dimensional view of one form of step-type heat-exchanger constructed in accordance with the present invention.
Figure 2:
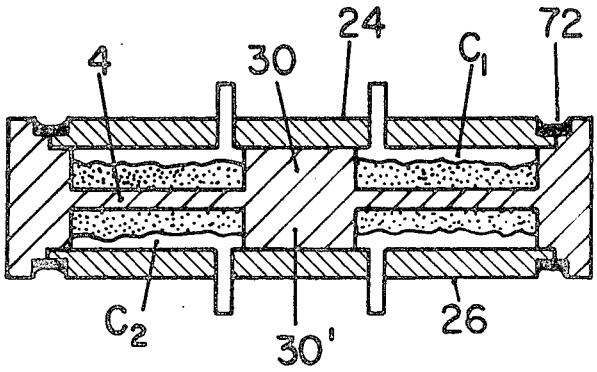
FIG. 2 is a transverse sectional view along lines II—II of FIG. 1.
Figure 3:
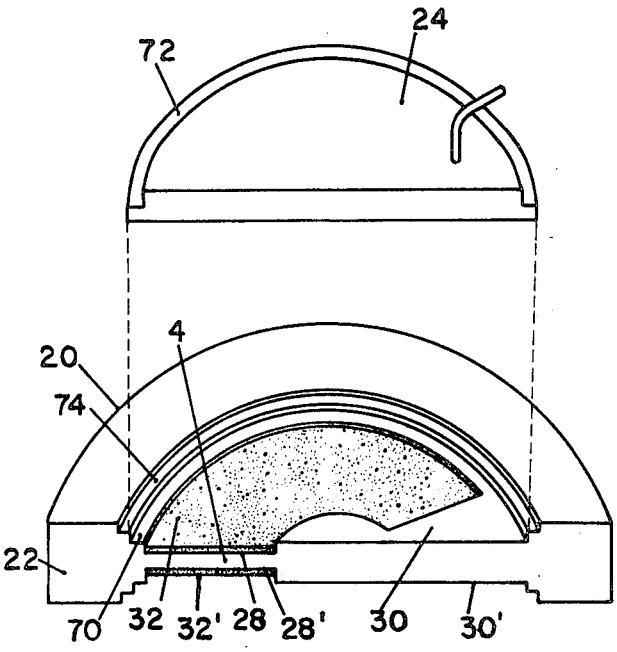
FIG. 3 is an enlarged, three-dimensional, exploded view illustrating the construction of the heat-exchanger of FIGS. 1 and 2.

The step-type heat-exchanger illustrated in FIGS. 1-3 is particularly for use in a dilution refrigerator to cool samples to a temperature approaching absolute zero. Briefly, it includes a housing, generally designated 2, containing a thermally-conductive member 4 (FIGS. 2 and 3) partitioning the interior of the housing into a first chamber $C_1$ and a second chamber $C_2$ on opposite sides of member 4. One side of the housing includes an inlet 6 for inletting a first heat-exchange fluid into chamber $C_1$, and an outlet 8 for outletting the fluid from that chamber; and the opposite side of the housing includes another inlet 10 for inletting a second heat-exchange fluid into chamber $C_2$, and an outlet 12 for outletting the fluid from that chamber. For example, "warm" helium liquid may be passed through chamber $C_1$ via its inlet 6 and outlet 8, to be cooled by "cold" helium liquid passed through chamber $C_2$ via its inlet 10 and outlet 12. In order to overcome the above-described Kapitza boundary resistance between the liquids and the metal body of the heat-exchanger at these very low temperatures in which the heat-exchanger is intended to operate, both chambers $C_1$ and $C_2$ are provided with very large surface contact areas for the heat-exchange fluids.

More particularly, the chamber partition 4 is integrally formed from a cylindrical body 20 of copper which has been dished, as the milling, in the center of both its faces to define a relatively thin central partition 4 circumscribed by a thicker outer section 22 constituting the side wall of the housing 2. Partition 4 thus serves as a common wall between the two chambers $C_1$ and $C_2$, which chambers are clsoed at their opposite sides by cover plates 24 and 26 applied over the dished portions of the copper body 20. The inlet 6 and outlet 8 for the upper chamber $C_1$ are formed through the upper cover plate 24, and the inlet 10 and outlet 12 for the lower chamber $C_2$ are formed in the lower cover plate 26.

The partition section 4 of the copper body 20 is formed on its upper face with an annular recess or channel 28 extending through an arc of less than 360° (e.g., about 330° ) so as to define a ledge 30 interrupting the recess, which ledge is disposed between the inlet 6 and outlet 8 of the upper chamber $C_1$. A sintered spongey layer 32 of fine thermally-conductive particles is bonded to the bottom of recess 28 and is formed of a thickness slightly less than the height of the recess. This provides a free space between the upper face of the sintered spongey layer 32 and the lower face of its cover plate 24 which space constitutes the upper chamber $C_1$. Ledge 30, which does not include the sintered spongey layer 32, extends above the spongey layer so as to engage the lower face of the cover plate 24 when applied thereto. This ledge thus acts as a barrier against the fluid in the chamber $C_1$ from traversing a complete loop within the chamber. Since the inlet 6 and outlet 8 are on opposite sides of ledge 30, the heat-exchange fluid introduced via inlet 6 will be directed to flow circumferentially through chamber $C_1$ in contact with the sintered spongey layer 32 therein, and will then be outletted via the outlet 8.

The lower face of partition member 4 is similarly formed with an annular recess 28′ having a sintered spongey layer 32′ and interrupted by a ledge 30′. This ledge similarly acts as a barrier directing the heat-exchange fluid inletted into chamber $C_2$ via inlet 10, to flow circumferentially around that chamber in contact with the sintered spongey layer 32′ and then to be outletted via outlet 12.

Both sintered spongey layers, 32, 32′, deposited on opposite sides of the partition member 4 are formed of fine Japanese silver powder of 700 Å sintered under heat and pressure. As indicated above, the sponge fills about ⅔ the height of each recess 28, 28′, the remaining height of the recess providing free space within the chamber for fluid flow. The channel thus has a very low flow impedance (Z) equal to about $1\times10^6$ cm$^{-3}$; viscous heating is therefore substantially negligible.

The powder is sintered in each recess by the use of a press made of aluminum, which provides two advantages: first, since aluminum oxidizes easily, there is no tendency for the silver powder to sinter to the aluminum press surface; in addition, since aluminum expands more than copper, the expansion of the aluminum, as the press is heated, e.g., to 200° C., applies an increased pressure on the powder to sinter it. In experiments performed with aluminum presses, there has been no indication that the pores on the sintered sponge surface tend to become closed by the press.

The copper body 20, at least its surfaces defining the recesses 28, 28', is preferably plated with a 1 micron layer of silver before the application of the fine Japanese silver powder. This has been found to promote the bonding of the sintered spongey silver layer such as to resist any attempts to chip and peel it away.

Figure 4:
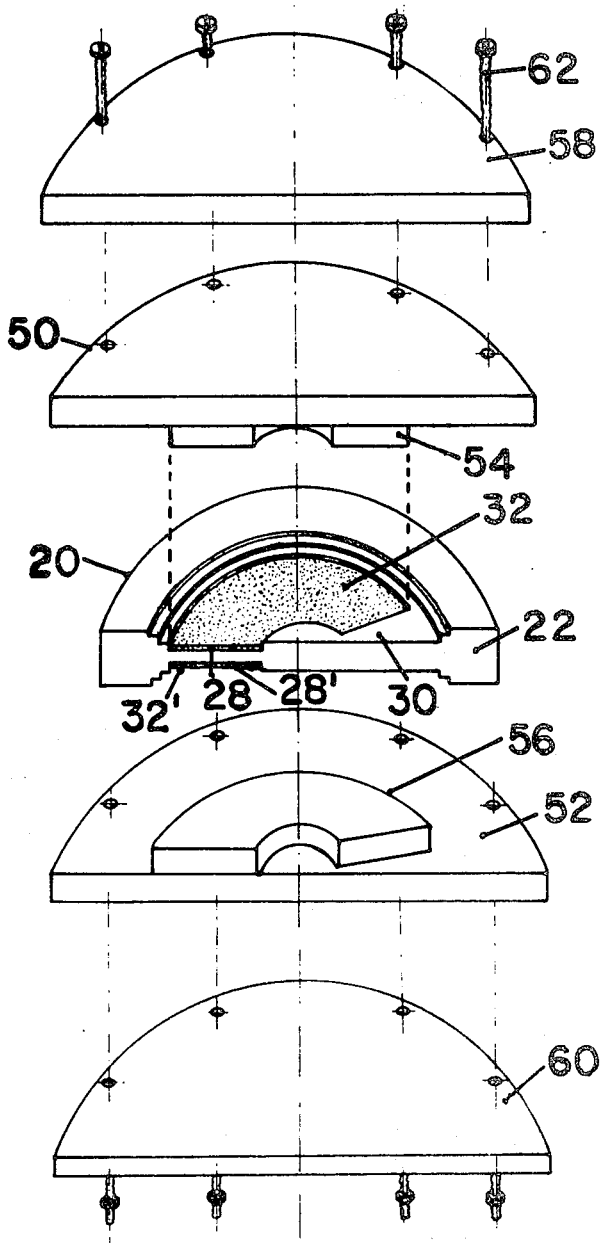
FIG. 4 is an exploded view illustrating the construction of the apparatus for use in making the heat-exchanger of FIGS. 1-3.

FIG. 4 illustrates one form of apparatus that was used for sintering the silver powder to form the sintered spongey layers, 32, 32', in the annular recesses 28, 28' on both sides of the chamber partition 4. Thus, as shown in FIG. 4, the copper body 20, including the fine Japanese silver powder 32, 32' in the annular recesses 28, 28' on both faces of its partition 4, was applied between an upper aluminum press plate 50 and a lower aluminum press plate 52. Both press plates included substantially annular ribs 54 and 56 conforming to the configuration of the recesses 28, 28' in the partition 4, which ribs were also made of aluminum. Outer plates 58 and 60, of polytetrafluorethylene, were applied to the outer faces of the aluminum plates 50, 52, and all of the foregoing elements were secured together by fasteners 62 passing through the latter plates as well as the aluminum plates 50, 52, with the copper body 20 interposed between the aluminum plates and with their annular ribs 54, 56 received within the annular recesses 28, 28' of the copper body 20. The unit was then heated to about 350° C. for several hours under a fairly good vacuum of $8\times10^{-6}$ mm/Hg to prevent oxidation of the powder.

After the copper body 20 has been formed with the two sintered spongey layers 32, 32', the two covers 24 and 26 are applied. Preferably, these covers are also made of copper. They are applied to the upper surface 70 circumscribing each of the recesses 28, 28', which upper surface thus defines a ledge which is a continuation of the previously-described barrier ledge 30. Each cover is also formed with a recess 72 along its outer edge, and a further recess 74 is formed around the edge of the copper body 20 defining the opening to receive soft solder. Thus, when the cover plates 24, 26 are seated within their respective ledges 70 around the sintered silver layers 32, 32', the two recesses 72 and 74 are in alignment with each other. These two recesses are then filled with a soft solder, e.g. a 60%–40% tin-lead solder, which is relatively soft, has a relatively low melting temperature (of about 180° C.) and is capable of adhering well to both copper and silver surfaces. During this soldering operation, the temperature of the copper body 20 should be kept as low as possible to prevent oxidation of the sintered silver layers. Prior to soldering, the chambers are preferably filled with an inert gas, such as $^4$He, to further prevent oxidation.

In the above-described example, the sponge thickness was 0.5 mm yielding a contact area of 10 m$^2$ with each fluid stream. The provision of the outer plates 58 and 60 of polytetrafluorethylene results in additional pressure being applied to the powder since this plastic expands more than the metals upon heating.

In the foregoing example, the copper body 20 was of electrolytic copper containing several hundred ppm of oxygen impurities. A second heat-exchanger was constructed from oxygen-free, high-conductivity copper, also using fine Japanese silver powder of 700 Å which was sintered using a hydrogen atmosphere. The sponge thickness in this embodiment was 1.5 mm, producing a contact area of 30 m$^2$ with each fluid stream.

Experimental results using the above-described heat-exchangers in series produced minimum temperatures of 11.6 mK for two, and 6.5 mK for four. These results compare very favorably to the other known heat-exchangers, particularly the fine copper-wire type which requires six heat-exchangers to product a minimum temperature of 10.5 mK in the mixing chamber. The reason for the excellent performance of the new step-type heat-exchangers is because of the large surface area, 10 m$^2$ and 30 m$^2$, respectively, which is a factor of about 1,000 times greater than the surface area in the previously-known wire-type heat-exchangers.

Figure 5:
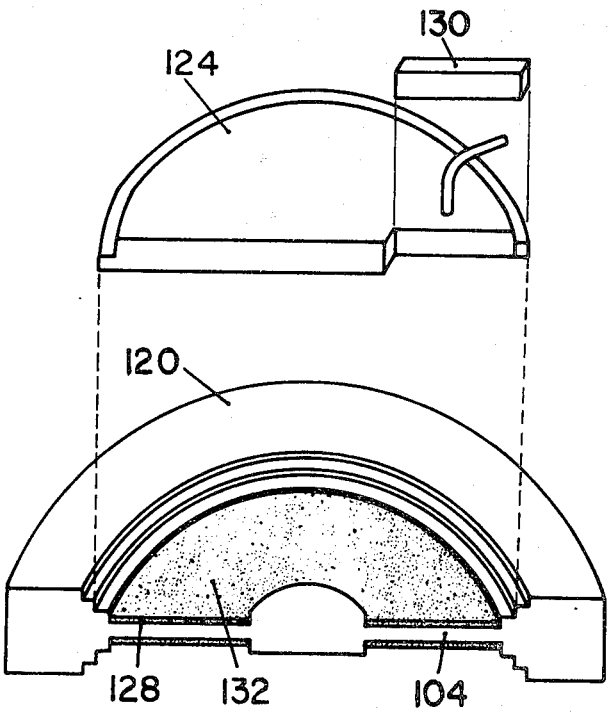
FIG. 5 is a view corresponding to that of FIG. 3 but illustrating a modification in the construction of the heat-exchanger.

FIG. 5 illustrates a variation in the heat-exchanger construction in order to simplify the manufacturing procedures and to lower the production costs. Thus, whereas in the heat exchangers illustrated in FIGS. 1–3, the barrier directing the fluid flow to the outlet, after transversing the sintered spongey layer, is provided by a ledge 30 formed as an interruption in each annular recess 28 containing the sintered silver layers 32, 32', in the FIG. 5 arrangement this barrier is provided by an insert 130 which is applied over the sintered silver layer 132 of each of the two chambers on the opposite sides of the partition member 104. As in the FIGS. 1–3 embodiment, this insert is interposed between the inlet and outlet of the respective chamber so as to direct the heat-exchange fluid to flow to the outlet after traversing the sintered silver layer of the respective chamber. Insert 130 may be applied separately through a suitable opening within the respective cover plate 124, or it may be integrally formed with the cover plate. In either case, the recesses (e.g. 128) and the sintered silver layer (e.g. 132) are both formed to extend a complete 360° circle, and the insert 130 comes into contact with the upper face of the sintered spongey layer between the inlet and outlet of the respective chamber. It will be seen that this modification simplifies the manufacture of the device.

A further possibility is to cut the channels by a lathe for the complete 360°, and then apply the sintered silver layers on the opposite sides of the partition member. The ledges (e.g. 30, 30', FIGS. 1–4) would then be fabricated by fitting the insert (130), as a section of a copper plate, tightly over each sintered silver layer, soft-soldering the copper inserts to the outside and inside walls of each recess, and then machining-down the inserts to the height of the step (70, FIG. 3). Because the sintered silver layers are strongly bonded to the conductive member (4), there would be little possibility of damaging the sintered layers during the machining-down of the copper inserts.

It should be possible to double the surface area of each channel without increasing its dimensions by sintering powder into the bottom surfaces of the cover plates (e.g. 24, 26); of course, the cover plates must be thermally anchored well to the body prior to the soft soldering step.

Unless the copper used for the thermally-conductive member (20 or 120) is virtually 100% free of oxygen, it is highly desirable to effect the sintering of the thermally-conductivity particles to form the spongy layers (e.g. 32, 32') on the opposite faces of this member in a vacuum of $5\times10^{-5}$ mm/Hg or better. Thus, even if OFHC ("oxygen-free high-conductivity") copper having only 10 ppm oxygen impurities is used for this member, it was found that this may still be sufficient oxygen to combine with the hydrogen gas, when sintering in a hydrogen-gas atmosphere, to form water vapor which may blow holes through the body after several thermal cyclings to the liquid helium temperature. This possibility is minimized by sintering in a vacuum, as described above. Alternatively, the sintering could also be performed in an inert gas, such a nitrogen, or in a reducing atmosphere consisting of carbon packed around the outside of the exchange body.

In addition, instead of using silver particles to produce the sintered spongy layer, there may also be used fine copper particles also of less than 1000 Å in size, but in this case it would be highly desirable to subject the particles to a reducing atmosphere to remove any oxide coatings thereupon. One such example is fine copper powder of 500 Å, which is black in appearance because of its thick oxide coating, the latter coating also rendering it electrically non-conductive. This copper powder may be easily reduced by flowing hydrogen gas over it at 250° C. for a few minutes, producing a red powder which packs nicely within each channel.

Before applying the so-reduced copper powder, the oxide coating, and also oils, on the channel walls of the thermally-conductive member (20 or 120) may be removed by rinsing this member in dilute HCl solution. The copper powder may then be sintered to the channels at 400° C. for one hour in a vacuum of $5\times10^{-5}$ mm/Hg.

The surface area of a sintered sponge of copper particles produced as described above was found to be 2.5 $m^2$/gm, using standard nitrogen gas adsorption isotherm techniques.

Thus, the advantages in using copper powder rather than silver powder are: (1) its substantially lower cost, being about 40% less expensive than the silver powder; (2) its greater surface area (e.g. 2.5 $m^2$/gm for copper powder, as compared to 2.15 $m^2$/gm surface area for silver powder); and (3) its ability to be sintered directly to the thermally-conductive member (20 or 120) without the need of a plated surface. The disadvantages of using copper powder over silver powder are: (1) the need to remove the oxide coating prior to the sintering; (2) the need to effect sintering at a higher temperature, e.g. 400° C. for copper powder as compared to sintering temperature of 250° C. for silver powder; and (3) the fact that copper sponge oxidizes faster than silver sponge.

While the invention has been described with respect to two preferred embodiments, it will be appreciated that many other variations, modifications and applications of the invention may be made.

What is claimed is:

1. A step-type heat-exchanger particularly useful for low temperature applications, comprising:

a housing including a thermally-conductive member partitioning its interior into a first chamber and a second chamber;

a sintered spongy layer of fine thermally-conductive particles bonded to each of two opposite sides of the thermally-conductive member so as to be exposed along a free face, opposite to its bonded face, for direct contact with a heat-exchange fluid when introduced into each of the two chambers, said housing defining, with the exposed free face of each of said sintered spongy layers, an open flow channel through each of said chambers;

first fluid inlet and outlet means for inletting and outletting a first heat-exchange fluid with respect to said first chamber to flow along said open channel therethru and in direct contact with said exposed free face of the sintered spongy layer therein; and second fluid inlet and outlet means for inletting and outletting a second heat-exchange fluid with respect to said second chamber to flow along said open channel therethru and in direct contact with said exposed free face of the sintered spongy layer therein;

said thermally-conductive member being of circular shape, and each of the sintered spongy layers being of substantially annular configuration and including a barrier between the inlet and outlet of the respective chamber to direct the respective heat-exchange fluid from the inlet to pass over the sintered spongy layer to the outlet of the respective chamber;

each of said sintered spongy layers being bonded within a substantially annular recess formed in the respective face of the thermally-conductive member, and having a thickness less than the height of the recess to define said open flow channel for the respective heat-exchange fluid;

said sintered spongy layers having sufficiently high conductivity and sufficiently large exposed faces in the open channels of the two chambers such that there is no significant temperature gradient between the inlet and outlet means of each of the two chambers.

2. A heat-exchanger according to claim 1, wherein each of said sintered spongey layers is of sintered silver particles having a particle size of less than 1,000 Å.

3. A heat-exchanger according to claim 2, wherein said thermally-conductive member is of copper and is plated with silver to promote the bonding of the sintered spongey layers thereto.

4. A heat-exchanger according to claim 1, wherein the thickness of each spongey layer is approximately two-thirds the height of the respective recess.

5. A heat-exchanger according to claim 1, wherein each of said sintered spongey layers is bonded to a centrally dished area in the respective face of the thermally-conductive member and is surrounded by an outer non-dished margin of the latter member which margin constitutes the side wall of the housing, said housing further including a pair of cover plates attached to overlie each of the dished faces of the thermally-conductive member, said inlets and outlets being formed through said cover plates.

6. A heat-exchanger according to claim 5, wherein the outer edges of said cover plates, and the edges of the housing receiving them, are formed with recesses both of which are filled with a solder for sealing the cover plates to the housing.

7. A heat-exchanger according to claim 1, wherein said barrier is constituted of an interruption in the substantially annular recess formed in each face of the thermally-conductive member.

8. A heat-exchanger according to claim 1, wherein said barrier is constituted of an insert applied over, and in contact with, said sintered spongey layer on each face of the thermally-conductive member.

9. A heat exchanger according to claim 1, wherein each of said sintered spongy layers is of sintered copper particles having a particle size of less than 1000 Å, which particles have been previously subjected to a reducing agent to remove any oxide coating thereon.

* * * * *